US009009885B2

(12) United States Patent
Faasse et al.

(10) Patent No.: US 9,009,885 B2
(45) Date of Patent: Apr. 21, 2015

(54) MODULAR WASTE DRAIN

(75) Inventors: Gene Earl Faasse, Easley, SC (US); Jeffrey H. Baldwin, Easley, SC (US); Richard Aloysius Fahey, Jr., Greenville, SC (US)

(73) Assignee: T & S Brass and Bronze Works, Inc., Travelers Rest, SC (US)

( * ) Notice: Subject to any disclaimer, the term of this patent is extended or adjusted under 35 U.S.C. 154(b) by 1346 days.

(21) Appl. No.: 12/428,849

(22) Filed: Apr. 23, 2009

(65) Prior Publication Data

US 2010/0269253 A1 Oct. 28, 2010

(51) Int. Cl.
*A01C 17/00* (2006.01)
*E03C 1/22* (2006.01)

(52) U.S. Cl.
CPC ..... *E03C 1/22* (2013.01)

(58) Field of Classification Search
CPC ..... E03C 1/22
USPC ..... 4/688–691, 650, 438, 441, 693, 695, 4/682, 679, 640; 251/213, 226, 318, 251/326–329; 241/30; 137/15.23, 315.29
See application file for complete search history.

(56) References Cited

U.S. PATENT DOCUMENTS

| | | | | |
|---|---|---|---|---|
| 187,545 | A * | 2/1877 | McEwan | 4/434 |
| 1,413,858 | A | 5/1922 | Leroi | |
| 2,597,399 | A * | 5/1952 | Steele | 4/287 |
| 4,377,274 | A * | 3/1983 | Mayhew, Jr. | 251/327 |
| 4,388,274 | A * | 6/1983 | Rourke et al. | 422/177 |
| 4,523,339 | A * | 6/1985 | Lavoie | 4/688 |
| 4,760,614 | A * | 8/1988 | Harrison | 4/255.06 |
| 5,082,247 | A * | 1/1992 | Owens et al. | 251/326 |
| 5,236,137 | A * | 8/1993 | Coogan | 241/30 |
| 5,678,802 | A | 10/1997 | Lunder | |
| 6,058,526 | A * | 5/2000 | Parisi et al. | 4/688 |
| 6,145,136 | A | 11/2000 | Parisi et al. | |
| 6,997,041 | B1 * | 2/2006 | Metzger et al. | 73/37 |

FOREIGN PATENT DOCUMENTS

| | | |
|---|---|---|
| CN | 2304698 | 1/1999 |
| WO | WO 2004/079109 A1 | 9/2004 |

OTHER PUBLICATIONS

Chicago Faucets Parts List, Jul. 7, 2000.
Chicago Faucets Spec Sheet, Fitting No. 1367, May 12, 2002.
Chicago Faucets Spec Sheet, Fitting No. 1366, May 14, 2002.
Chicago Faucets web page, Commercial Drain—Commercial Drains, 2007.
Fisher Manufacturing Company Spec Sheet, DrainKing Waste Valve with Flat Strainer, 2007.
Fisher Manufacturing Company Spec Sheet, DrainKing Waste Valve Rough Chrome with Flat Strainer, 2007.
Fisher Manufacturing Company Spec Sheet, DrainKing Waste Valve with VR Flat Strainer & Knob, 2007.
Fisher Manufacturing Company Spec Sheet, DrainKing Waste Valve Rough Chrome with VR Flat Strainer & Knob, 2007.
(Continued)

*Primary Examiner* — Joel Zhou
(74) *Attorney, Agent, or Firm* — Dority & Manning, P.A.

(57) ABSTRACT

A modular waste drain can includes at least two of the following separate modules that can be selectively attached and detached from each other: an inlet assembly, an outlet assembly and a knife gate valve. An additional module can be provided by a valve guard assembly.

6 Claims, 6 Drawing Sheets

(56) References Cited

OTHER PUBLICATIONS

Fisher Manufacturing Company Spec Sheet, DrainKing Waste Valve with Locking Basket Strainer & Overflow Body, 2007.
Fisher Manufacturing Company Spec Sheet, DrainKing Waste Valve Rough Chrome with Locking Basker Strainer & Overflow Body, 2007.
Fisher Manufacturing Company Spec Sheet, DrainKing Waste Valve with Locking Basket Strainer, 2007.
Fisher Manufacturing Company Spec Sheet, DrainKing Waste Valve Rough Chrome with Locking Basket Strainer, 2007.
Fisher Catalog (6 pages), Waste Valves, 2007.
www.plumbingsupply.com/images/fisher-drainkinq-components.jpg, Fisher DrainKing Components jpg webpage, 2007.
www.made-in-china.com/showroom/happyvalley/product-detail, Made-in-China.com webpage, Sink Strainer (RN-110102S), 2007.
Valterra Products, Inc. Brochure, 10" & 12" Gate Valves, Ball Valves, 2007.
Valterra Products, Inc. Brochure, RV Accessories, 2007.
CHG Component Hardware web page, Plumbing Products—Drains, 2007.
English translation of First Office Action issued by the State Intellectual Property Office of the People's Republic of china, dated May 27, 2011.
European Search Report, Sep. 1, 2010.
English translation of Decision of Rejection issued by the State Intellectual Property Office of the People's Republic of China, dated Mar. 31, 2012.

* cited by examiner

MODULAR WASTE DRAIN

CROSS-REFERENCE TO RELATED APPLICATIONS

N/A

STATEMENT REGARDING FEDERALLY SPONSORED RESEARCH OR DEVELOPMENT

N/A

BACKGROUND OF THE INVENTION

A waste drain used in commercial food service applications is typically installed in large commercial sinks as the sink drain. Conventional waste drains typically use a one piece body construction that is specific to an inlet/outlet combination. Each significantly different inlet and/or outlet sink connection requires a different waste drain specifically tailored to that particular inlet and/or outlet connection. The different combinations mean that a substantial inventory must be maintained.

To open and close the conventional waste drain, one might find a "ball" valve or a "cylinder valve or a "rotor" valve or a "pop-up" valve permanently installed in the one piece body of the drain. Each of these valves would be actuated only by a handle directly connected to the waste drain, and so access to the handle was often inconvenient due to obstructions in the environment of the drain. Overflow ports for a conventional waste drain are typically located on the opposite side of the waste drain from the handle, and this location cannot be varied during installation of the drain and so also might become inconveniently disposed. Moreover, ball valves and cylinder valves are relatively expensive.

The size of the passage through the valve of a conventional waste drain is typically less than the size of the passage through the connecting pipes and thus limits the passage of drain cleaning equipment through the conventional waste drain. Where the drain includes a cylinder valve, the mechanics and assembly of the parts of such valves further limit the size of the passage of the valve body, thereby further limiting the use of drain cleaning equipment. The same is true of some drains that include a ball valve.

OBJECTS AND SUMMARY OF THE INVENTION

It is a principal object of the present invention to provide a modular waste drain that can be configured for installation in any inlet/outlet combination, including custom applications.

It is another principal object of the present invention to provide a modular waste drain that can be reconfigured while the drain is still installed in the sink.

It is a further principal object of the present invention to provide a modular waste drain with inlet assemblies and outlet assemblies that are indexable for multiple positions to allow ease of connection, routing of plumbing or positioning of the handle.

It is still another principal object of the present invention to provide a modular waste drain with outlet assemblies that are indexable for multiple positions of the overflow port.

It is a still further principal object of the present invention to provide a modular waste drain that employs a knife gate valve, which is compact in size, durable, economical and allows for easy maintenance and replacement of a component that is unacceptably damaged or worn.

It is yet another principal object of the present invention to provide a modular waste drain that allows for an increase in the flow through rate relative to conventional commercial waste drains.

It is an additional principal object of the present invention to provide a modular waste drain with valve gate member having a sharp edge that will slice through some obstructions that extend across the valve opening when the valve gate member is moving from the open position to the closed position.

It is an additional further principal object of the present invention to provide a modular waste drain with an unobstructed passage through the waste drain for easy passage of drain cleaning equipment.

It is another additional principal object of the present invention to provide a modular waste drain with a valve body passage that is greater than the current drain pipe size typically connected to waste drains.

It is yet a further principal object of the present invention to provide a modular waste drain configured to allow it to be opened and closed by an actuating assembly that is accessible remotely from the waste drain.

It is yet an additional principal object of the present invention to provide a modular waste drain that can be remotely actuated by such means that include one or more of mechanical apparatus, electric motor and electric solenoid.

It is a still additional principal object of the present invention to provide a modular waste drain with a handle guard that protects the valve handle and/or valve body from accidental damage or abuse.

It is yet a still further principal object of the present invention to provide a modular waste drain with a handle guard that is designed to withstand loads and impact forces that would typically damage and impair the actuation of the valve in a conventional waste drain.

Additional objects and advantages of the invention will be set forth in part in the description that follows, and in part will be obvious from the description, or may be learned by practice of the invention. The objects and advantages of the invention may be realized and attained by means of the instrumentalities and combinations particularly pointed out in the appended claims.

To achieve the objects and in accordance with the purpose of the invention, as embodied and broadly described herein, a presently preferred embodiment of a modular waste drain includes at least the following separate modules that can be selectively attached and detached from each other: an inlet assembly, an outlet assembly and a knife gate valve. In an alternative preferred embodiment, an additional module is provided by a valve guard assembly. In a further alternative preferred embodiment, the knife gate valve need only be detachably connected to at least one of the inlet assembly and the outlet assembly.

The inlet assembly defines an inlet passage, and the outlet assembly defines an outlet passage. The knife gate valve has a valve body that defines a valve opening, and the waste drain defines a waste passage that includes the inlet passage, the outlet passage and the valve opening. The valve body of the knife gate valve can be detachably connected to the inlet assembly and detachably connected to the outlet assembly. The knife gate valve includes a gate member that is disposed within the valve body and configured to be selectively slidable between a closed position and an open position, wherein the valve opening is completely closed in the closed position and completely open in the open position. A valve handle has one end connected to the gate member and an opposite end selectively moveable with respect to the valve body. A valve guard assembly can include a cross bar that can be connected to the selectively moveable end of the handle. Alternatively, the valve guard assembly can include an actuating assembly that can have one end connected to the selectively moveable end of the handle and an opposite end remotely disposed from the waste drain and that can be used by the operator to effect remote opening and closing of the knife gate valve.

The accompanying drawings, which are incorporated in and constitute a part of this specification, illustrate at least one presently preferred embodiment of the invention as well as some alternative embodiments. These drawings, together with the description, serve to explain the principles of the invention but by no means are intended to be exhaustive of all of the possible manifestations of the invention.

DETAILED DESCRIPTION OF THE PREFERRED EMBODIMENTS

Reference now will be made in detail to the presently preferred embodiments of the invention, one or more examples of which are illustrated in the accompanying drawings. Each example is provided by way of explanation of the invention, which is not restricted to the specifics of the examples. In fact, it will be apparent to those skilled in the art that various modifications and variations can be made in the present invention without departing from the scope or spirit of the invention. For instance, features illustrated or described as part of one embodiment, can be used on another embodiment to yield a still further embodiment. Thus, it is intended that the present invention cover such modifications and variations as come within the scope of the appended claims and their equivalents. The same numerals are assigned to the same components throughout the drawings and description.

Figure 1:
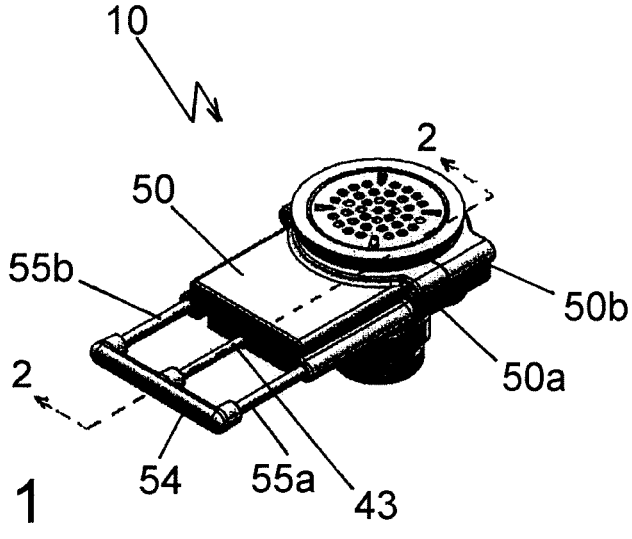
FIG. 1 is an elevated perspective view of a presently embodiment of the modular waste drain of the present invention.
Figure 2:
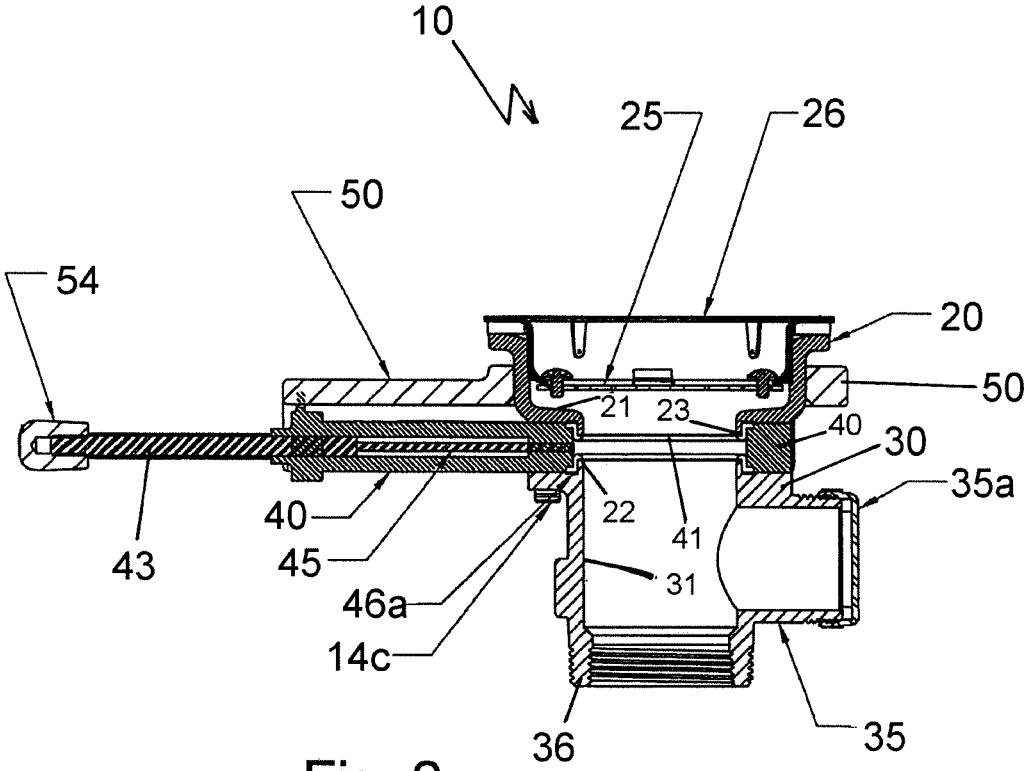
FIG. 2 is a cross-sectional view taken along the direction of the arrows shown designated 2-2 in FIG. 1.
Figure 3:
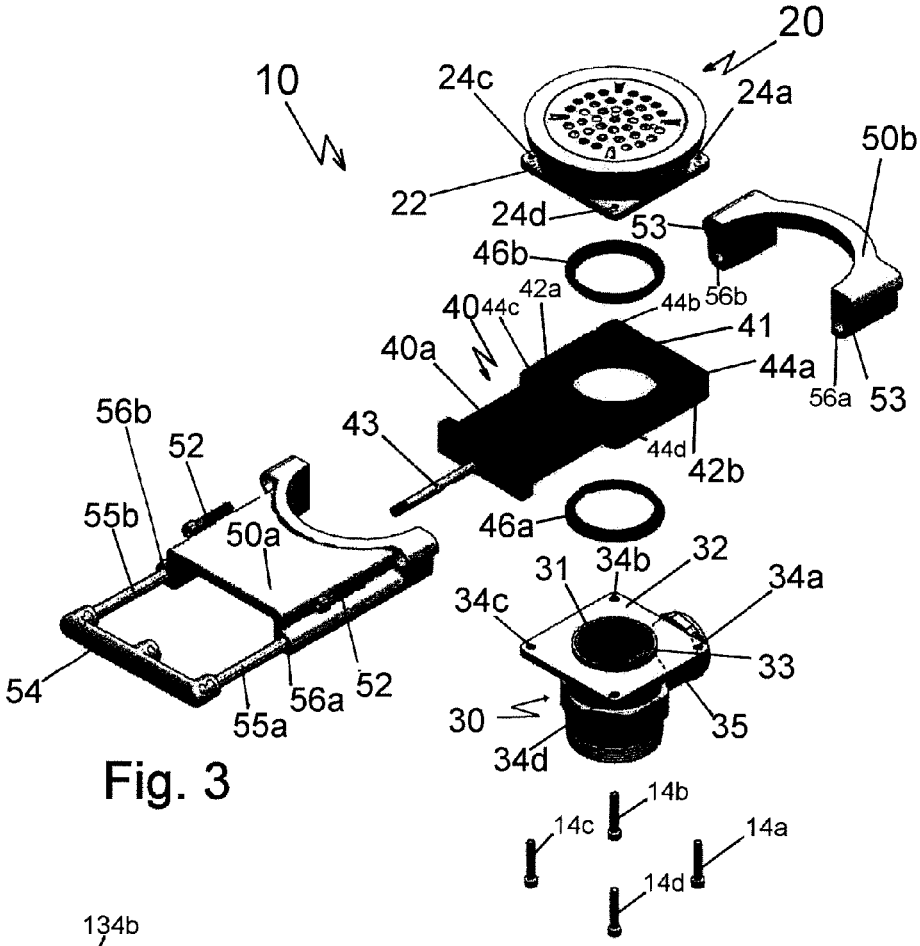
FIG. 3 is an elevated perspective assembly view of the embodiment of FIGS. 1 and 2.
Figure 3A:
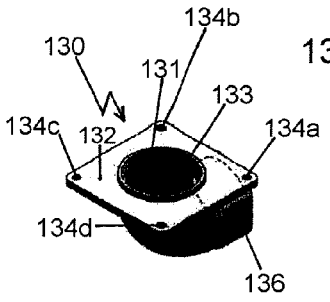
FIG. 3A is an alternative embodiment of a component of the present invention.
Figure 3B:
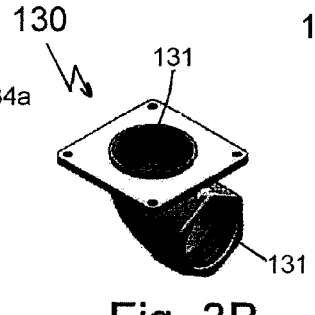
FIG. 3B is an alternative embodiment of a component of the present invention.
Figure 3C:
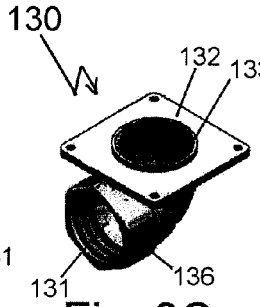
FIG. 3C is another alternative embodiment of a component of the present invention.
Figure 3D:
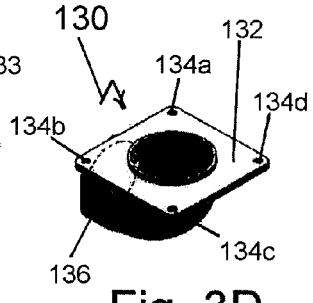
FIG. 3D is a further alternative embodiment of a component of the present invention.

A presently preferred embodiment of the modular waste drain is shown in FIGS. 1-3 and is represented generally by the numeral 10. As shown in FIG. 3 for example, the modular waste drain 10 includes at least the following separate modules that can be selectively attached and detached from each other: an inlet assembly 20, an outlet assembly 30 and a knife gate valve 40. In an alternative embodiment, an additional module can be provided by a valve guard assembly 50 as shown in FIGS. 1 and 2 for example. In a further alternative embodiment, the knife gate valve need only be detachably connected to at least one of the inlet assembly and the outlet assembly.

Figure 4:
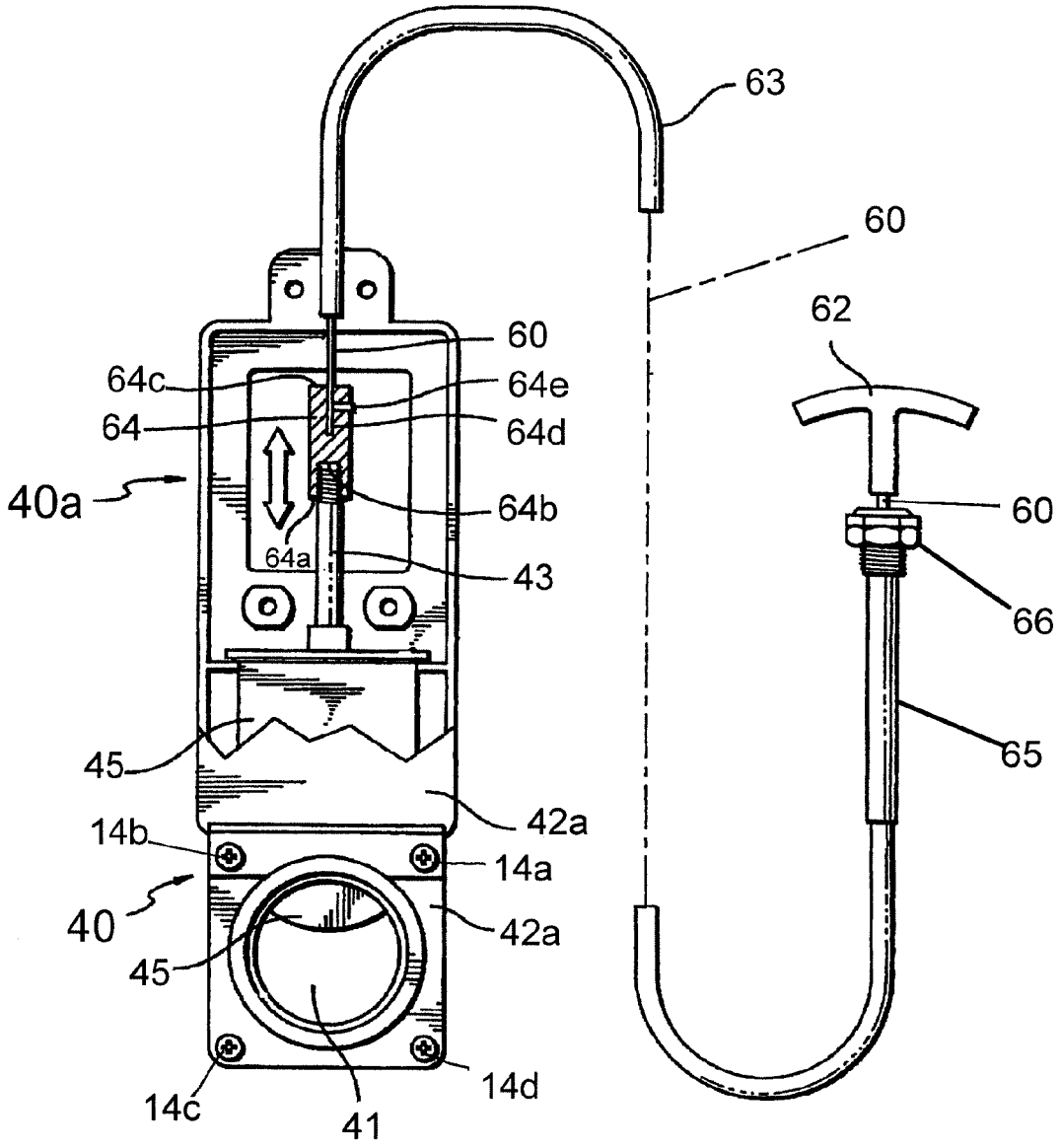
FIG. 4 is a top plan view with portions cut away of an alternative embodiment of a component of the present invention.

As shown in FIG. 2, the inlet assembly 20 defines an inlet passage 21 internally thereof, and the outlet assembly 30 defines an outlet passage 31 internally thereof. As shown in FIGS. 2, 3 and 4, the knife gate valve 40 defines a valve opening 41. Similarly, as shown schematically in FIGS. 4C and 4D, the respective knife gate valve 140, 240 defines a valve opening 141, 241. As shown in FIG. 2 for example, the valve opening 41 is disposed between the inlet passage 21 and the outlet passage 31, and thus the modular waste drain 10 defines a waste passage for the flow of waste therethrough and that includes the inlet passage 21, the outlet passage 31 and the valve opening 41. Accordingly, the respective valve opening 41, 141, 241 is positioned so that the respective valve 40, 140, 240 can be operated to control the flow of waste that is allowed to pass through the modular waste drain 10. Moreover, as shown in FIG. 2 for example, the valve opening 41 is at least as wide as the outlet passage 31, and thus allows for an increase in the flow through rate relative to conventional commercial waste drains In accordance with the present invention, the knife gate valve can be detachably connected to at least one of the inlet assembly and the outlet assembly. Desirably, the knife gate valve can be detachably connected to both of the inlet assembly and the outlet assembly. As shown in FIG. 3, each of the inlet assembly 20 and the outlet assembly 30 is provided with a respective attachment flange 22, 32. As shown in FIG. 3, the attachment flange 22 of the inlet assembly 20 is defined as a peripherally extending flange at the outlet 23 (FIG. 2) of the inlet passage 21. As shown in FIG. 3, the attachment flange 32 of the outlet assembly 30 is defined as a peripherally extending flange at the inlet 33 of the outlet passage 31. As shown in FIG. 3, the knife gate valve 40 includes a valve body 40*a*. Each of the respective attachment flanges 22, 32 desirably is configured to mate snugly with an opposite surface on the topside 42*a* and the underside 42*b* of the valve body 40*a* around the valve opening 41 of the knife gate valve 40.

Each of the respective attachment flanges 22, 32 desirably is configured with the same shape, but need not be identically configured so long as the opposing surfaces are designed to mate snugly to each other. Moreover, as shown in FIG. 3, at least one attachment hole 24*a*, 34*a* defined in each respective attachment flange 22, 32 is configured to be aligned with a corresponding attachment hole 24*a*, 34*a* of the other flange 22, 32 and aligned with a corresponding attachment hole 44*a* through the body 40*a* of the knife gate valve 40. Desirably, each of a plurality of respective attachment holes 24*a*, 24*b*, 24*c*, 24*d* defined in the attachment flange 22 of the inlet assembly 20 is aligned with a corresponding one of the respective attachment holes 34*a*, 34*b*, 34*c*, 34*d* defined through the attachment flange 32 of the outlet assembly 30 and with a corresponding one of the respective attachment holes 44*a*, 44*b*, 44*c*, 44*d* defined through the valve body 40*a*.

At least one selectively detachable connector is configured to bias the knife gate valve 40 against the inlet assembly 20 and against the outlet assembly 30. As shown in FIGS. 2 and 3, the at least one selectively detachable connector can include a screw 14*a*, and desirably additional screws 14*b*, 14*c*, 14*d* beyond the one screw 14*a* are provided as shown in FIG. 3. Desirably, each screw 14*a*, 14*b*, 14*c*, 14*d* can be passed through one of the corresponding aligned attachment holes 34*a*, 34*b*, 34*c*, 34*d* in the outlet assembly 30 and thence passed through one of the corresponding aligned attachment holes 44*a*, 44*b*, 44*c*, 44*d* in the valve body 40*a* of the knife gate valve 40 and threaded into the corresponding aligned attachment hole 24*a*, 24*b*, 24*c*, 24*d* in the inlet assembly 20 so that installation of the modular waste drain 10 can be accomplished from beneath the sink. Alternatively, the at least one selectively detachable connector can include a bolt that is passed through the attachment holes in the attachment flanges 22, 32 and the valve body 40*a* of the knife gate valve, and a threaded nut could receive the threaded end of each bolt.

Details of the construction and operation of a suitable knife gate valve 40 are disclosed in U.S. Pat. No. 5,678,802, which is hereby incorporated herein by this reference for all purposes. As shown in FIGS. 2 and 3, the knife gate valve 40 includes a valve handle 43 that has one end connected to a valve gate member 45. The valve gate member 45 is disposed within the valve body 40*a* and is configured to be selectively slidable between a closed position and an open position. In the view shown in FIG. 2, the valve gate 45 is disposed in the open position whereby the valve opening 41 is completely open. In the view shown in FIG. 4 for example, the valve gate member 45 is partially occluding the valve opening 41. Thus, the valve handle 43 that has one end connected to the valve gate member 45 can be selectively moveable in a straight line to control opening and closing of the knife gate valve 40. In the embodiment shown in FIGS. 1-4 for example, straight line movements of the valve handle 43 effect sliding movements of the valve gate member 45 between the open position and the closed position.

Figure 4A:
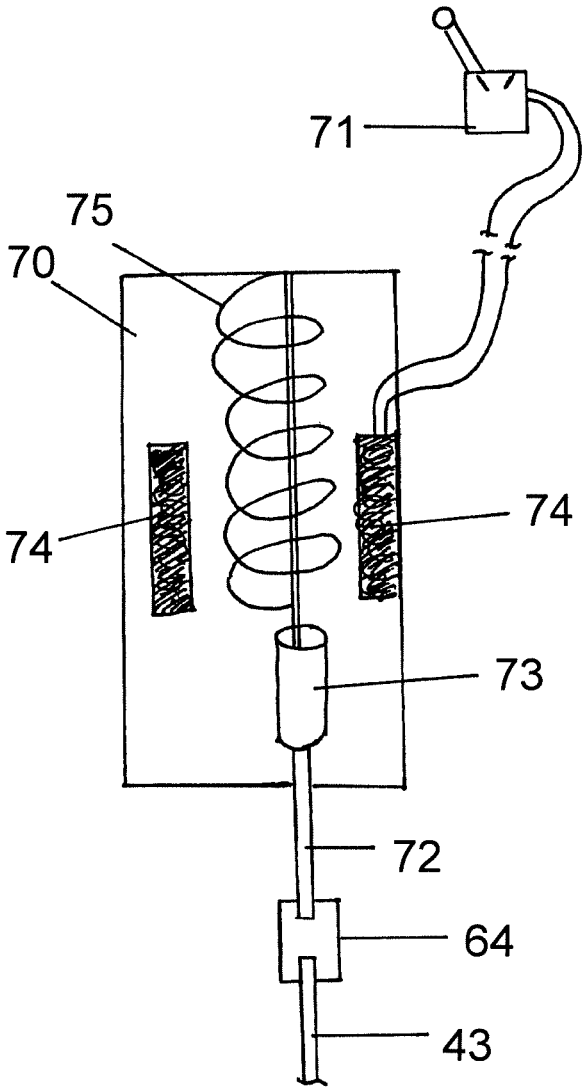
FIG. 4A schematically presents alternative embodiments of components of an embodiment of the present invention.
Figure 4B:
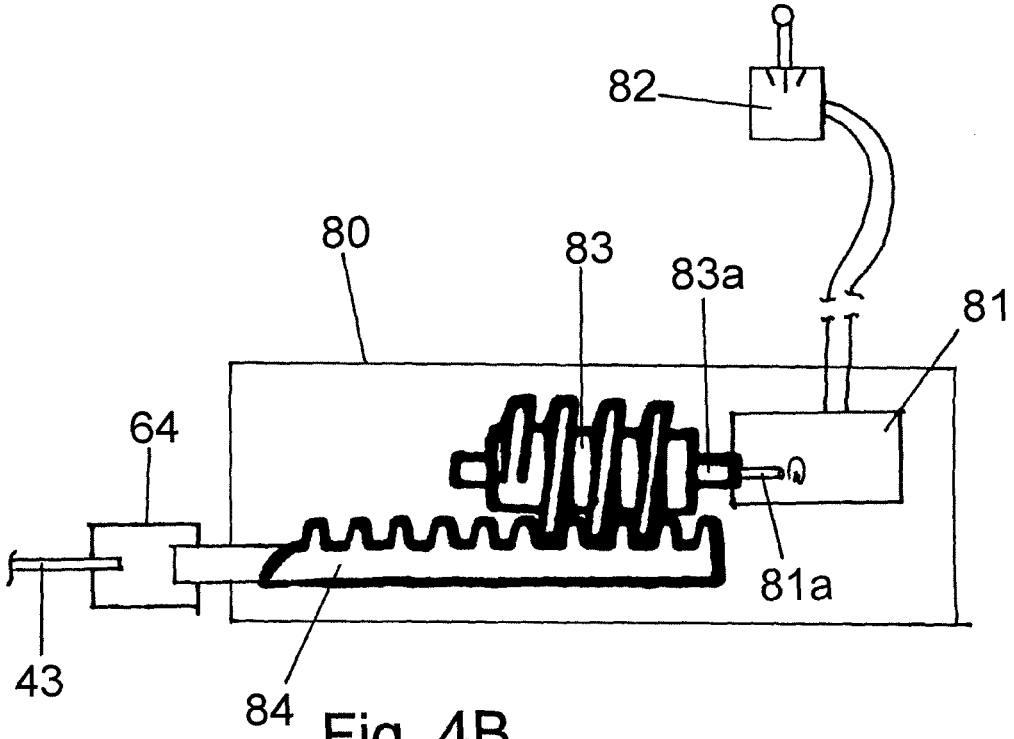
FIG. 4B schematically presents alternative embodiments of components of an embodiment of the present invention.
Figure 4C:
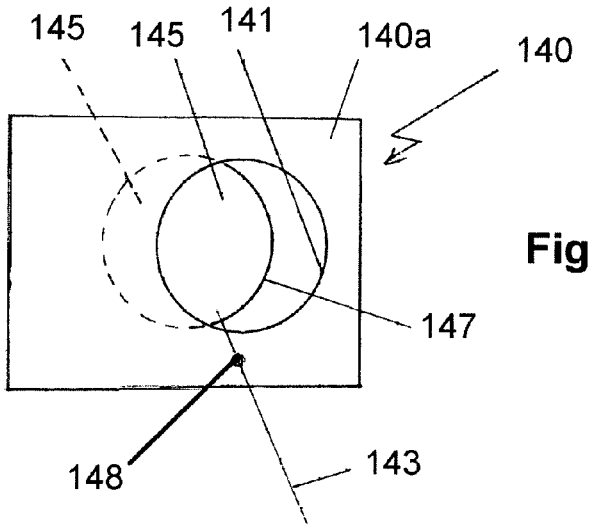
FIG. 4C schematically presents alternative embodiments of components of an embodiment of the present invention.

In one alternative embodiment of the knife gate valve schematically shown in FIG. 4C, a valve handle 143 is selectively moveable about a pivot point 148 to control opening and closing of the knife gate valve 140. As schematically shown in FIG. 4C, the valve body 140*a* defining the valve opening 141 desirably can be configured to permit the valve gate member 145 attached to the valve handle 143 to open and close with a pivoting movement as in a pendulum movement.

Figure 4D:
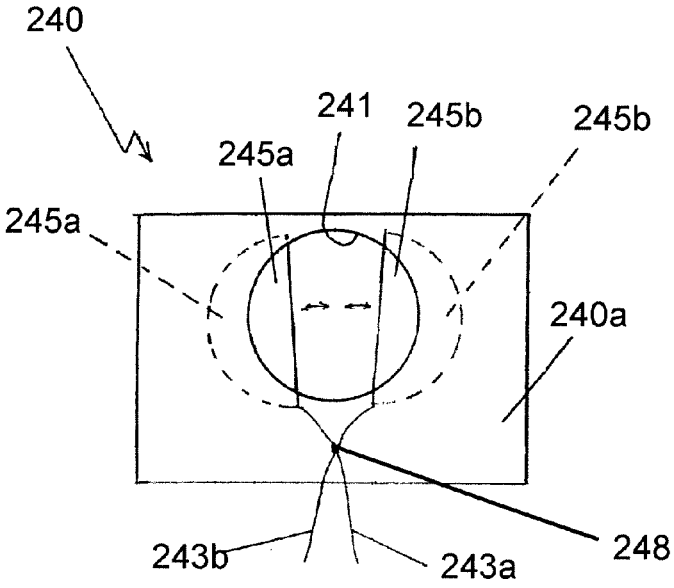
FIG. 4D schematically presents alternative embodiments of components of an embodiment of the present invention.
Figure 4E:
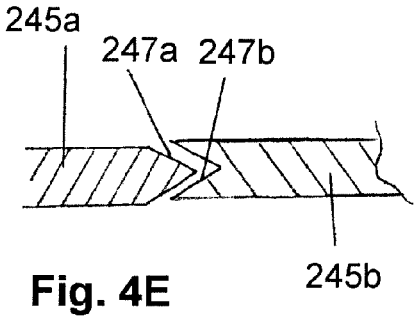
FIG. 4E schematically presents alternative embodiments of components of an embodiment of the present invention.

In another alternative embodiment of the knife gate valve 240 schematically shown in FIG. 4D, each of a pair of valve handles 143*a*, 143*b* is selectively moveable about a pivot point 248 to control opening and closing of the knife gate valve 240. As schematically shown in FIG. 4D, the valve body 240*a* defining the valve opening 241 desirably can be configured to permit a scissors movement of each of two pieces 245*a*, 245*b* forming the valve gate. Each respective piece 245*a*, 245*b* of the valve gate is connected to its own respective valve handle 243*a*, 243*b*. As schematically shown in FIGS. 4D and 4E, the two pieces 245*a*, 245*b* forming the valve gate pivot to separate to open and come together to close as reminiscent of the movements of the blades of a scissor.

Each of the elements forming the valve gate member 45, 145, 245*a*, 245*b* desirably is formed of a flat plate of stainless steel having a thickness on the order of about one sixteenth of an inch to about three thirty-seconds of an inch. As shown in FIG. 4, the leading edge 47 of the valve gate member 45 is desirably formed as a sharp edge that will slice through some obstructions that extend across the valve opening 41 when the valve gate member is moving from the open position to the closed position. The same is true for the leading edge 147 of the valve gate member 145 schematically shown in FIG. 4C and the leading edges 247*a*, 247*b* of the pieces 245*a*, 245*b* of the valve gate member shown schematically in FIG. 4E.

In order to guard against a leading edge (47, 147, 247*a*, 247*b*) of the valve gate member severing a worker's finger that might be placed inadvertently across the valve opening during movement of the valve gate into the closed position, as shown in FIG. 2 for example, an inlet guard 25 can be provided for the inlet assembly 20. The inlet guard 25 desirably is detachably connected to the inlet assembly 20 and disposed across the inlet passage 21 of the inlet assembly 20, thereby preventing a worker from placing a digit into the path of the valve gate member. Additionally, as shown in FIGS. 1-3, a removable flat or basket strainer 26 can be attached to the externally projecting open end of the inlet assembly 20.

In accordance with an alternative preferred embodiment of the present invention, the modular waste drain desirably includes a valve guard assembly that is connected to the knife gate valve and disposed to shield the knife gate valve from external impacts. As shown in FIG. 2, the valve guard assembly 50 desirably is connected to the inlet assembly 20, which is received through an opening defined internally of the guard member 50. As shown in FIG. 3, the valve guard assembly includes a front end 50*a*, a back end 50*b* and at least one connecting element that selectively holds the front end 50*a* to the back end 50*b*. Each of the front end 50*a* and the back end 50*b* desirably is formed of a strong, rigid material that can carry out the protective function of the valve guard assembly 50, and examples of suitable materials include aluminum, zinc alloy suitable for die casting, and bronze. As shown in FIG. 3, one embodiment of a connecting element can be an elongated connecting screw 52 that has one end threaded into a threaded aperture 53 that is defined within the back end 50*b* of the guard member 50. Desirably, a pair of elongated connecting screws 52 can be employed with one connecting screw 52 being disposed to each opposite side of the guard member 50. Each of the two screws 52 shown in FIG. 3 desirably can be fitted with a head that receives a tool non-rotatably therein. An example of such a tool would be an Allen wrench. Tightening of the screws 52 would result in drawing the front end 50*a* against the back end 50*b* so that the inlet assembly 20 would be secured between the front end 50*a* and the back end 50*b* of the valve guard assembly 50 as shown in FIG. 2 for example.

As shown in FIGS. 1-3, the valve guard assembly 50 desirably includes a crossbar 54 that is connected to the end of the valve handle 43 opposite the end of the valve handle 43 that is connected to the valve gate member 45. As shown in FIGS. 1-3, the valve guard assembly 50 desirably further includes at least one support rod 55*a* disposed parallel to the valve handle 43 and connected to the crossbar 54. Desirably, a support rod 55*a* or 55*b* is disposed to each side of the valve handle 43, and the two support rods 55*a*, 55*b* lie in a common plane with the valve handle 43. Each of the support rods 55*a* or 55*b* desirably is connected to a respective opposite end of the crossbar 54. Additionally, as shown in FIG. 3 for example, for each support rod 55*a* or 55*b* a respective elongated channel 56*a* or 56*b* is defined within the main body of the valve guard assembly 50 and configured to receive the support rod therein. As shown in FIG. 3 for example, each respective elongated channel 56*a* or 56*b* is defined within both the front end 50*a* and the back end 50*b* of the main body of the valve guard assembly 50. Each support rod 55*a*, 55*b* is slidable selectively into and out of its respective channel 56*a*, 56*b*. Thus, even when the valve handle 43 is positioned so that the valve opening 41 is completely open and the valve handle 43 is fully extended out of the knife gate valve 40, the support rods 55*a*, 55*b* and the cross bar 54 of the valve guard assembly 50 still partially protect the valve handle 43 from impacts coming from either opposite side and to one end of the valve handle 43.

Provision desirably can be made for remote actuation of the opening and closing of the modular waste drain of the present invention. A remote actuator assembly desirably is connected to the knife gate valve and configured to permit opening and closing of the valve from a location remote from the waste drain. In one embodiment of the remote actuator assembly shown in FIG. 4 for example, an actuating cable 60 can be provided with one end connected to the valve handle 43. An opposite end of the actuating cable 60 desirably is remotely disposed from the end of the actuating cable 60 that is connected to the valve handle 43. The force needed to operate the remote actuator assembly is manually supplied by the user. As shown in FIG. 4, a manual grip 62 desirably is connected to the remotely disposed opposite end of the cable 60 so that when the operator pulls on the manual grip 62, the cable 60 is withdrawn from a surrounding cable sleeve 63 and pulls on the valve handle 43 in a manner that opens the valve opening 41. As shown in FIG. 4, the end of the actuating cable 60 that is connected to the manual grip 62 can be passed through a rigid tube 65 having a fixture 66 for installation to the sink so as to deploy the manual grip 62 where the operator has easy access to the manual grip 62.

As shown in FIG. 4, one end 64*a* of a rigid adapter 64 can be provided with a threaded opening 64*b* to receive a threaded end of the valve handle 43, while the opposite end 64*c* of the rigid adapter 64 can be provided with a conduit 64*d* that receives the end of the cable 60 and retains the end of the cable 60 therein by means of a set screw 64*e*. When the valve opening 41 is open, pushing on the manual grip 62 pushes the valve handle 43 in a manner that closes the valve opening 41. When the valve opening 41 is closed, pulling on the manual grip 62 pulls the valve handle 43 in a manner that opens the valve opening 41. Moreover, in an alternative embodiment, a linkage (not shown) can be introduced between the cable 60 and the valve handle 43 so that pushing on the manual grip 62 opens the valve opening 41 and pulling on the manual grip 62 closes the valve opening 41.

In other embodiments of the remote actuator assembly shown schematically in FIGS. 4A and 4B for example, an electromechanical actuating assembly can be provided with electrical power supplying the force needed to operate the remote actuator assembly. The electromechanical actuating assembly can be connected to the valve handle 43 by means of any connection mechanism, which might include a rigid adapter 64. As shown schematically in FIG. 4A for example, the electromechanical actuating assembly can include a solenoid actuator 70 that can be electrically actuated by an on/off switch 71 that is remotely located from the waste drain. The switch 71 can be mounted on the sink for example. One end of the solenoid stem 72 can be connected to the valve handle 43, and the opposite end of the solenoid stem 72 can be connected to the armature 73. When the switch 71 is closed, current flows through the coil 74 that creates a magnetic field pulling the armature 73 into the space within the coil and force-loading the reset spring 75. This linear motion also pulls the valve handle 43 toward the actuator 70 and depending on the configuration, either opens or closes the knife gate valve 40. When the switch 71 is open, current is cut off from the coil 74 and the magnetic field disappears, thus allowing the reset spring 75 to move the armature 73 away from the coil 74 (the condition shown in FIG. 4A) and also pushing the valve handle 43 away from the actuator 70.

As shown schematically in FIG. 4B for example, another embodiment of an electromechanical actuating assembly can include an actuator 80 with an electric motor 81. The electric motor 81 that operates the electromechanical actuator can be electrically actuated by a switch 82 that is remotely located from the waste drain. The switch 82 can be a three position switch (forward on-off-reverse on) mounted on the sink for example. Any of a number of different ways can be provided to convert the rotational motion of the armature of a motor into linear translational motion. As shown schematically in FIG. 4B for example, the shaft 83*a* of a worm screw 83 can be connected to the armature 81 a of the motor 81. One end of a rack 84 that has teeth rotatably engaged by the worm screw 83 can be connected to the valve handle 43. When the switch 82 is closed, current flows to the motor 81 and rotates the armature 81 a in either the clockwise or counterclockwise direction depending on the position of the switch 82. Rotation of the armature 81*a* causes the worm screw 83 to rotate in the same direction. Rotation of the worm screw 83 linearly moves the rack 84 either toward or away from the actuator 80. Depending on the configuration, this linear motion of the rack 84 also either pulls the valve handle 43 toward the actuator 80 or pushes the valve handle 43 away from the actuator 80 and either moves the valve gate member 45 toward the open position or toward the closed position of the knife gate valve 40. When the switch 82 is open, current is cut off from the motor 81 and the linear movement of the valve handle 43 stops, thus allowing the operator to position the valve gate member 45 at an intermediate location so that the valve opening 41 is partially open and partially closed.

As shown in FIG. 2, at least one selectively removable seal 46*a* is desirably disposed between the knife gate valve 40 and at least one of the inlet assembly 20 and the outlet assembly 30. Desirably, as shown in FIGS. 2 and 3, one seal 46*a* is disposed to rest on the upper surface of the attachment flange 32 of the outlet assembly 30 surrounding the inlet 33 of the outlet passage 31 to thereby make water tight sealing contact with the underside 42*b* of the knife gate valve 40 and in the region of the valve body 40*a* surrounding the valve opening 41. This first seal 46*a* butts against the inlet 33 of the outlet passage 31 of the outlet assembly 30.

As schematically shown in FIG. 3, a second seal 46*b* desirably is disposed to rest on the lower surface of the attachment flange 22 of the inlet assembly 20 to thereby make water tight sealing contact with the topside 42*a* of the knife gate valve 40 and in the region of the valve body 40*a* surrounding the valve opening 41. This second seal 46*b* butts against the outlet 23 of the inlet passage 21 of the inlet assembly 20. Each of these seals 46*a*, 46*b* is desirably formed of a resiliently deformable, water impermeable material such as rubber. These seals 46*a*, 46*b* can be replaced easily when the outlet assembly 30 is detached from the valve body 40*a* of the knife gate valve 40 and the knife gate valve 40 is detached from the inlet assembly 20.

As shown in FIG. 2, the outlet assembly 30 desirably includes an overflow port 35 disposed downstream of the inlet 33 of the outlet passage 31 and upstream of the discharge end 36 of the outlet passage 31. The overflow port 35 desirably extends in a direction that is at a right angle to the direction of the flow through the outlet passage 31 of the outlet assembly 30. The overflow port 35 desirably can be externally threaded to receive a cap 35*a* that is screwed onto the end of the overflow port 35 and seals the overflow port 35. The cap 35*a* can be unscrewed and removed when it is desired to open the overflow port 35. Alternatively, the overflow port 35 desirably can be internally threaded to receive a threaded plug that can be screwed into the end of the overflow port 35 to seal the overflow port 35 and selectively unscrewed and removed when it is desired to open the overflow port 35.

As shown in FIG. 2, the discharge end 36 of the outlet assembly 30 desirably can be internally threaded to receive a connecting pipe. Desirably, the discharge end 36 of the outlet assembly 30 also can be externally threaded to be connected to a connecting pipe. Moreover, though not shown, a threaded plug or a threaded cap can be screwed, respectively, into the internal threads or onto the external threads of the discharge end 36 of the outlet assembly 30 if it is desired to connect the outlet assembly 30 through the overflow port 35 to the sewer line for example.

An alternative embodiment of an outlet assembly 130 is shown in each of FIGS. 3A, 3B, 3C and 3D in four successive different 90 degree orientations. This embodiment 130 of the outlet assembly shown in each of FIGS. 3A, 3B, 3C and 3D is configured with a right angle elbow between the inlet 133 of the outlet passage 131 and the discharge end 136. This embodiment of the outlet assembly 130 is similarly provided with a suitable attachment flange 132 that desirably is identically configured as the attachment flange of the embodiment of the outlet assembly 30 shown in FIG. 3 and thus is easily substituted therefor.

Similarly, because the embodiment of an outlet assembly 30 shown in FIG. 3 has four connector holes 34*a*, 34*b*, 34*c*, 34*d*, the outlet assembly 30 can be disposed in any of four different orientations with the overflow port 35 facing any one of four different directions. The number of orientations for directing the overflow port 35 is equivalent to the respective number of symmetrically spaced respective connector holes 24*a*, 24*b*, 24*c*, 24*d*, etc., 34*a*, 34*b*, 34*c*, 34*d*, etc. that can be aligned in each of the respective attachment flanges 22, 32, of the inlet assembly 20 and the outlet assembly 30 and the respective connector holes 44*a*, 44*b*, 44*c*, 44*d*, etc. of the valve body 40*a* of the knife gate valve 40. When installing the modular waste drain 10, the overflow port 35 in the embodiment of FIGS. 2 and 3 and the discharge end 136 of the embodiment of any of FIGS. 3A, 3B, 3C and 3D can be oriented in any of the possible orientations determined by the number of aligned and symmetrically arranged respective connector holes in the respective attachment flanges.

Because the knife gate valve 40 is detachably connected to the inlet assembly 20 and detachably connected to the outlet assembly 30, the modular waste drain 10 of the present invention can be reconfigured and/or repaired while the drain 10 is still installed in the sink. Replacing the seals 46*a*, 46*b* when they become degraded is a relatively simple operation. Moreover, a different inlet assembly 20 and/or outlet assembly 30 can be installed relatively simply.

While at least one presently preferred embodiment of the invention has been described using specific terms, such description is for illustrative purposes only, and it is to be understood that changes and variations may be made without departing from the spirit or scope of the following claims.

What is claimed is:

1. A modular waste drain assembly for a vessel having a drain opening that communicates with a drain line through which the vessel discharges matter to a sewer, comprising: an inlet assembly defining an inlet passage, the inlet assembly being configured to fit into the drain opening of the vessel; an outlet assembly defining an outlet passage, the outlet assembly having a discharge end configured for connection to the drain line; and a knife gate valve having a valve opening disposed between the inlet passage and the outlet passage, the knife gate valve defining a valve body having a first end and a second end, the first end being detachably connected to the inlet assembly by at least one selectively detachable connector and the second end being detachably connected to the outlet assembly; a valve guard assembly connected to the knife gate valve and disposed to shield the knife gate valve from external impacts.

2. A modular waste drain as in claim 1, further comprising: a valve guard assembly connected to the knife gate valve and disposed to shield the knife gate valve from external impacts.

3. A modular waste drain as in claim 1, wherein the valve guard assembly is connected to the inlet assembly.

4. A modular waste drain as in claim 1, wherein the valve guard assembly includes a front end, a back end and at least one connecting element that selectively holds the front end to the back end.

5. A modular waste drain as in claim 1, wherein the at least one connecting element is a screw.

6. A modular waste drain as in claim 1, wherein: the knife gate valve includes a valve handle that is selectively moveable to effect opening and closing of the knife gate valve; the valve guard assembly includes a cross bar connected to the valve handle; the valve guard assembly further includes at least one support rod disposed parallel to the valve handle and connected to the cross bar; and the valve guard assembly defines an elongated channel receiving the support rod therein and wherein the support rod is slidable selectively into and out of the channel.

* * * * *